US008578514B2

(12) United States Patent
Caillibotte et al.

(10) Patent No.: US 8,578,514 B2
(45) **Date of Patent: *Nov. 12, 2013**

(54) GARMENT

(75) Inventors: Michel Caillibotte, Weisendorf (DE); Vincent Philippe Rouiller, Collonges au Mont d'or (FR)

(73) Assignee: adidas International Marketing B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/401,513

(22) Filed: Feb. 21, 2012

(65) Prior Publication Data

US 2012/0144549 A1 Jun. 14, 2012

Related U.S. Application Data

(63) Continuation of application No. 12/607,678, filed on Oct. 28, 2009, now Pat. No. 8,356,363, and a continuation of application No. 11/052,534, filed on Feb. 7, 2005, now Pat. No. 7,631,367.

(30) Foreign Application Priority Data

Feb. 10, 2004 (DE) ..... 10 2004 006 485

(51) Int. Cl.
*A41D 13/00* (2006.01)

(52) U.S. Cl.
USPC ..... 2/69

(58) Field of Classification Search
USPC ..... 2/69, 79, 228, 238, 456, 69.5, 227, 115, 2/911, 78.3, 401; 182/105; 450/101, 106, 450/107, 123, 130, 131
See application file for complete search history.

(56) References Cited

U.S. PATENT DOCUMENTS

| | | | |
|---|---|---|---|
| 1,128,682 | A | 2/1915 | Homewood |
| 1,535,481 | A | 4/1925 | Kjelgaard |
| 1,633,610 | A | 6/1927 | Schneider |
| 1,839,489 | A | 1/1932 | Meroussis |
| 2,550,327 | A | 4/1951 | Christensen |

(Continued)

FOREIGN PATENT DOCUMENTS

| | | |
|---|---|---|
| EP | 1563748 | 8/2005 |
| JP | 2002-212814 | 7/2002 |

OTHER PUBLICATIONS

"Adidas Equipment Fullbody Suit: adidas Revolutionizes Swimming", adidas International, B.V. (Sep. 4, year unknown) adidas Media Announcment: Photo Opportunity.

(Continued)

*Primary Examiner* — Tejash Patel
(74) *Attorney, Agent, or Firm* — Kilpatrick Townsend & Stockton LLP

(57) ABSTRACT

A garment for a part of the body, and in particular a sport pant, includes an elasticity element, or a number of such elements, disposed on a portion of the garment, while another portion of the garment is free of elasticity elements. As a result, the garment can store energy by elastic elongation under a movement of, for example, a leg. This energy can then be released under a second movement of the leg in the opposite direction, resulting in the garment supporting the second movement of the leg.

19 Claims, 7 Drawing Sheets

(56) References Cited

U.S. PATENT DOCUMENTS

| | | | |
|---|---|---|---|
| 3,015,829 | A | 1/1962 | George |
| 3,286,287 | A | 11/1966 | Knox |
| 3,786,526 | A | 1/1974 | Ausseil |
| 3,975,929 | A | 8/1976 | Fregeolle |
| 4,015,448 | A | 4/1977 | Knohl |
| 4,153,050 | A | 5/1979 | Bishop et al. |
| 4,176,665 | A | 12/1979 | Terpening |
| 4,180,065 | A | 12/1979 | Bowen |
| 4,311,135 | A | 1/1982 | Brueckner et al. |
| 4,371,989 | A | 2/1983 | Polsky |
| 4,488,317 | A | 12/1984 | Polsky |
| 4,502,301 | A | 3/1985 | Swallow et al. |
| 4,502,473 | A | 3/1985 | Harris et al. |
| 4,538,615 | A | 9/1985 | Pundyk |
| 4,570,625 | A | 2/1986 | Harris |
| 4,654,894 | A | 4/1987 | Kudo |
| 4,670,913 | A | 6/1987 | Morell et al. |
| 4,698,847 | A | 10/1987 | Yoshihara |
| 4,785,480 | A | 11/1988 | Polsky |
| 4,862,523 | A | 9/1989 | Lipov |
| 5,046,194 | A | 9/1991 | Alaniz et al. |
| 5,052,053 | A | 10/1991 | Peart et al. |
| 5,055,075 | A | 10/1991 | Waller, Jr. |
| 5,109,546 | A | 5/1992 | Dicker |
| 5,139,475 | A | 8/1992 | Robicsek |
| 5,161,257 | A | 11/1992 | Arensdorf et al. |
| 5,176,600 | A | 1/1993 | Wilkinson |
| 5,186,701 | A | 2/1993 | Wilkinson |
| 5,201,074 | A | 4/1993 | Dicker |
| 5,282,277 | A | 2/1994 | Onozawa |
| 5,306,222 | A | 4/1994 | Wilkinson |
| 5,338,235 | A | 8/1994 | Lee |
| 5,359,732 | A | 11/1994 | Waldman |
| 5,367,708 | A | 11/1994 | Fujimoto |
| 5,431,030 | A | 7/1995 | Ishizaki et al. |
| 5,465,428 | A | 11/1995 | Earl |
| 5,546,955 | A | 8/1996 | Wilk |
| 5,570,472 | A | 11/1996 | Dicker |
| 5,603,232 | A | 2/1997 | Throneburg |
| 5,606,745 | A | 3/1997 | Gray |
| 5,659,895 | A | 8/1997 | Ford, Jr. |
| 5,671,482 | A | 9/1997 | Alvera |
| 5,700,231 | A | 12/1997 | Wilkinson |
| 5,707,266 | A | 1/1998 | Arena |
| 5,720,042 | A | 2/1998 | Wilkinson |
| 5,720,472 | A | 2/1998 | Ohgitani |
| 5,737,773 | A | 4/1998 | Dicker et al. |
| 5,745,917 | A | 5/1998 | Dicker et al. |
| 5,768,703 | A | 6/1998 | Machado et al. |
| 5,787,509 | A | 8/1998 | Alvera |
| 5,819,322 | A | 10/1998 | Dicker |
| 5,826,761 | A | 10/1998 | Basaj |
| 5,839,122 | A | 11/1998 | Dicker |
| 5,867,827 | A | 2/1999 | Wilkinson |
| 5,875,491 | A | 3/1999 | Wilkinson |
| 5,894,970 | A | 4/1999 | Belkin |
| 5,898,948 | A | 5/1999 | Kelly et al. |
| 5,937,442 | A | 8/1999 | Yamaguchi et al. |
| 5,978,966 | A | 11/1999 | Dicker |
| 5,994,612 | A | 11/1999 | Watkins |
| 5,996,120 | A | 12/1999 | Balit |
| 6,047,405 | A | 4/2000 | Wilkinson |
| 6,047,406 | A | 4/2000 | Dicker |
| D427,750 | S | 7/2000 | Fujii |
| 6,098,198 | A | 8/2000 | Jacobs et al. |
| 6,112,502 | A | 9/2000 | Frederick et al. |
| 6,176,816 | B1 | 1/2001 | Dicker |
| 6,186,970 | B1 | 2/2001 | Fujii et al. |
| 6,231,488 | B1 | 5/2001 | Dicker et al. |
| 6,258,014 | B1 | 7/2001 | Karecki |
| 6,311,334 | B1 | 11/2001 | Reinhardt et al. |
| 6,314,584 | B1 | 11/2001 | Errera |
| 6,368,256 | B1 | 4/2002 | Rumbaugh |
| 6,430,752 | B1 | 8/2002 | Bay |
| 6,430,753 | B2 | 8/2002 | Duran |
| 6,438,755 | B1 | 8/2002 | MacDonald et al. |
| 6,446,264 | B2 | 9/2002 | Fairhurst et al. |
| 6,546,560 | B2 | 4/2003 | Fusco et al. |
| 6,684,410 | B2 | 2/2004 | Robinett et al. |
| 6,874,337 | B2 | 4/2005 | Uno et al. |
| D512,203 | S | 12/2005 | Ota et al. |
| D514,774 | S | 2/2006 | Africa et al. |
| 7,631,367 | B2 | 12/2009 | Caillibotte et al. |
| 8,356,363 | B2 * | 1/2013 | Caillibotte et al. ..... 2/69 |
| 2001/0029224 | A1 | 10/2001 | Karecki |
| 2003/0028952 | A1 | 2/2003 | Fujii et al. |
| 2003/0140391 | A1 | 7/2003 | Richards et al. |
| 2003/0208829 | A1 | 11/2003 | Ragot et al. |
| 2004/0016043 | A1 | 1/2004 | Uno et al. |
| 2004/0078865 | A1 | 4/2004 | Culhane |
| 2004/0107479 | A1 | 6/2004 | Dicker et al. |
| 2004/0111781 | A1 | 6/2004 | Miyake et al. |
| 2004/0255358 | A1 | 12/2004 | Ota et al. |
| 2005/0166298 | A1 | 8/2005 | Pieroranzio |
| 2005/0193461 | A1 | 9/2005 | Caillibotte et al. |
| 2010/0043114 | A1 | 2/2010 | Caillibotte et al. |
| 2012/0151653 | A1 | 6/2012 | Caillibotte et al. |

OTHER PUBLICATIONS

"The Most Innovative adidas Products Based on the Athletes Needs Engineered for Performance": information on equipment bodysuit, adidas International, B.V. (date unknown) adidas Equipment.

"A Swimsuit Issue: Out of the Frying Pan", Author unknown, Sports Illustrated, Dec. 14, 1998, p. 34.

"Adidas Equipment Bodysuit: Press Information.", adidas International B.V., (at least as early as Jun. 25, 1998).

"Adidas International B.V.,", Advertisement: Men's Apparel, 1999.

"Lycra@ Power Only by DuPont", DuPont (U.K.) Limited.

"Quick Swim Facts", adidas International, B.V. (date unknown) adidas Media Announcement.

"Slippery When Wet: Teflon Suit Takes the Drag Out of Swimming", Aqua Magazine, Feb. 1999, p. 14.

"Swim in Your adidas", City Sports Magazine, Nov. 1998.

"Technology Behind the Equipment Fullbody Suit", adidas International, B.V. (date unknown) adidas Media Announcement.

"The Equipment Fullbody Suit", Adidas America, Available web site: http://adidas_america/publications/scoops/swim/swim.htm, Accessed on: Oct. 27, 1998.

"The influence of proprioception ?", adidas International, B.V. (Feb. 14, 2000) adidas Media Release:, Feb. 14, 2000.

Binole , "Swimmers hope to go faster with adidas suit", The Business Journal., Nov. 20, 1998.

Binole , "This swimsuit won't make SI's cover", Sports Business Journal., Nov. 30, 1998.

Collcutt et al., "All-over costume aims to put speed and style in the swim", Times of London, Jul. 7, 1998.

Dolbow , "The Score: The Look of Swim to Come?", Sportstvle, Oct. 1998, p. 7.

Feitelberg , "Sport Report: adidas Has Swimwear Covered", Women's Wear Daily, vol. 176(72):10., Oct. 15, 1998.

Kraemer et al., "Influence of a Compression Garment on Repetitive Power Output Production Before and After Different Types of Muscle Fatigue", Sports Med., Training and Rehab., vol. 8(2): 163-184, 1998.

Lord , "Putting the squeeze on in the fast lane", Times of London, Jul. 15, 1998.

McMorris , "Personal Trainer Great Gear: Does it Work?", Sports Illustrated for Women, 1999, 118-119.

Mendel , "Dressed to Compress", Athletic Management, Feb.-Mar. 1994, pp. 40, 42, and 44.

Parrack , "ASA National Championships and Commonwealth Trials", Swimming Times, Aug. 1998, pp. 5 and 9.

Sharp et al., "Influence of Body Hair Removal on Physiological Responses During Breaststroke Swimming", Medicine and Science in Sports and Exercise, vol. 21(5): 576-580, Oct. 1989.

Smith , "The Man with the Golden Feet", Sports Illustrated, Nov. 22, 1999, 7 pages ending on page No. 114.

Stromgren Supports, Inc., , "Online history and product information", Available web site: http:www.stromgren.com/history.htm and

(56) References Cited

OTHER PUBLICATIONS http://www.stromqren.com/study.htm, Accessed on May 31, 2000, 1999-2000.
Torres , "PulseFitness: Does it Work? Well Suited", Rodale's Fitness Swimmer, May-Jun. 1999.
Weede , "Power Suits", Sportstyle, Dec. 1998.
Weiss , "Can Lycra® Power Improve Your Performance?", About.com [Online], Available web site: http://bicycling.about.com/sports/bicycling/library/weekly/aa080697.htm?iam=ask&terms=lycra, Accessed on: Feb. 23, 2000., Aug. 6, 1997.
Williams et al.,"Swimming Performance and Hydrodynamic Characteristics of Harbor Seals Phoca Vitulina", Physiological Zoology, vol. 58(5): 576-589, Sep.-Oct. 1985.

* cited by examiner

GARMENT

CROSS-REFERENCE TO RELATED APPLICATION

This application is a continuation of U.S. patent application Ser. No. 12/607,678, filed on Oct. 28, 2009, now allowed, which is a continuation of U.S. application Ser. No. 11/052,534, filed on Feb. 7, 2005, now U.S. Pat. No. 7,631,367, issued on Dec. 15, 2009, which claims priority to and the benefit of, German patent application serial number 102004006485.7, filed on Feb. 10, 2004, the entire disclosure contents of each of which is hereby incorporated herein by reference.

TECHNICAL FIELD

The present invention relates to a garment for a part of the body, and in particular to a sport pant.

BACKGROUND OF THE INVENTION

Generally, a garment for use during sports has several functions. Aside from aesthetic aspects, sporting garments should not hinder the performance of an athlete, but on the contrary should support the athlete wherever possible. To this end, several approaches are known in the prior art.

Elastic textile materials using elastic fibers, such as those sold by DuPont under the registered trademark Lycra®, have been used for many different sports to ensure a close contact between the garment and the skin of an athlete. For example, pants or suits for cyclists and track and field athletes can be made from this material, in order to achieve a low air resistance. Furthermore, the pressure exerted by garments made from an elastic fabric increases micro-blood circulation in the muscles and improves proprioception, which can lead to improved performance in an athlete.

In addition, garments may also be used for maintaining the performance of an athlete in specific situations. For example, U.S. Pat. No. 5,367,708, the disclosure of which is incorporated herein by reference in its entirety, discloses a garment having sections of a particularly high elasticity in order to selectively support certain parts of the body, in the same manner as by bandaging with an elastic band (so-called "taping"). This can, for example, help prevent a further spraining in the case of an already sprained ankle or wrist, thus allowing the athlete to continue to perform the sport.

Other approaches to improving athletic performance are directed towards an intensification of resistance during training. For example, U.S. Pat. Nos. 5,201,074, 5,875,491, 5,867,827, and 6,047,405, the disclosures of which are incorporated herein by reference in their entireties, disclose garments comprising elastic elements or weights, in order to subject muscles to higher than normal loads when moved. This can be used for training purposes and for rehabilitation after an injury. The disclosed elements are integrated into a suit or pant in such a manner that an additional resistance is created for every movement. U.S. Pat. No. 5,201,074, the disclosure of which is incorporated herein by reference in its entirety, for example, teaches an arrangement of elastic straps in a spiral configuration on all sides around the leg in order to provide the greatest possible amount of resistance in an anatomically correct manner, and to exercise a greater part of the muscles during walking or running. U.S. Pat. Nos. 5,875,491 and 5,867,827, the disclosures of which are incorporated herein by reference in their entireties, teach an arrangement of resistance elements in a suit that provides a higher resistance than the underlying base fabric, not only under a stretching movement, but also under a return movement into the original configuration.

Such garments, however, can only indirectly increase the performance of an athlete. The disclosed suits and pants subject the muscles to a particular loading, which is only of benefit in strengthening muscles during training, rather than directly enhancing performance in competition. The present invention, on the contrary, addresses the problem of providing a garment which directly contributes to an increase in the performance of an athlete, such as a sprinter.

SUMMARY OF THE INVENTION

The invention is based on the realization that the muscles of a human, such as a trained athlete, can provide in certain parts of the body more force than necessary for an optimal course of movement. Conversely, an external support for other movements may allow for an improved performance. A sprinter, for example, can easily pull up the leg due to the powerful front muscles of the thighs. From the extensive energy available from such a movement, a portion can be stored in the garment of the present invention. Once the leg has reached the highest point, the speed of the leg is close to zero, similar to a pendulum at the highest point before the acceleration in the downward direction begins. Using the present invention, this acceleration is supported and thereby increased by the energy stored in the garment from an initial movement. Any additional force leads to a faster course of movements and to a stronger forward thrust and, thereby, can increase the velocity of the sprinter. Similar situations can be found in other sports, such as cycling, rowing, and tennis.

The anatomical imbalance explained above is, therefore, at least partly compensated for if the garment stores energy under a first movement, and then later releases the energy in the correct phase, in the course of a second movement. This is achieved through the unique arrangement of elasticity elements in at least the first portion of the garment, and not in the second portion of the garment, on the opposite side of the part of the body. Thus, the garment according to the invention allows the energy provided by an athlete over the different phases of a periodically repeated movement to be more evenly distributed and, therefore, more efficiently used to provide for maximal performance. In contrast to the training devices from the prior art, which provide an increased resistance for any movement of the part of the body in order to strengthen the muscles during training, the present invention supports the second movement alone, and thereby directly achieves a performance-enhancing effect.

In one aspect, the invention relates to a garment for at least a portion of a body. The garment comprises a first portion, which includes at least one elasticity element disposable on a first area of the body. A second portion of the garment is disposable on an area of the body substantially opposite the first area of the body and is substantially free of the elasticity element. The garment stores energy by elastic elongation of the elasticity element under a first movement of the portion of the body, and the garment releases this energy under a second movement of the portion of the body into an opposite direction, the garment thereby supporting the second movement of the portion of the body.

In various embodiments of the invention, at least one elasticity element is disposable on a backside of a thigh, with substantially no elasticity element disposable on a front side of the thigh. In one embodiment, the at least one elasticity element extends substantially parallel to the thigh, while in an alternative embodiment the at least one elasticity element can extend substantially diagonally across the thigh. In this embodiment, several elasticity elements can cross on the backside of the thigh. Alternatively, the at least one elasticity element is disposable on at least one of an elbow, a shoulder, a neck, a wrist, a waist, a back, a hip, a knee, a calf, or an ankle.

Further, the elasticity element can include a fastening portion disposed at a lower end thereof, where the lower fastening portion at least partially circumscribes the leg above a knee and below the thigh. In one embodiment, the elasticity element can further include a fastening portion disposed at an upper end thereof, with the upper fastening portion at least partially circumscribing the body above the thigh.

In additional embodiments of the invention, the at least one elasticity element can comprise an elastic band, which can be disposed on a textile material portion of the garment. The elastic band can be attached to the garment by being either glued to, sewn to, or injected onto the textile material portion of the garment, or through another appropriate attachment technique. In one particular embodiment of the invention, the at least one elastic band can have a thickness less than about 1 mm, and in one preferred embodiment the elastic band can have a thickness of about 0.2 mm. The elastic band can also have a width of between about 1 cm and about 5 cm. In an alternative embodiment, at least one of the thickness and the width of the at least one elastic band can vary over its length.

In another embodiment of the invention, the at least one elastic band can be elongated by up to 100% of its unstressed length. As a result, the elastic band can provide a restoring force, under an elongation of 100%, of between about 5 N and about 50 N. In a particular embodiment of the invention, the elastic band can provide a restoring force, under an elongation of 100%, of between about 20N and about 30N. In a particular embodiment, the elastic band can comprise a thermoplastic polymer.

The arrangement of the elasticity elements reflects the field of use of the garment, as the elasticity elements are specifically applied to provide active support to certain muscle chains. For example, a parallel arrangement of one or more elasticity elements on the backside of the thigh is preferred for a linear motion such as sprinting, whereas a diagonal arrangement is preferred for a sport pant for multidirectional motion, such as in soccer, to effectively support movement encompassing frequent changes of directions, for example during dribbling.

Alternative embodiments of the invention are also envisioned. For example, elasticity elements can be arranged on different portions of the garment, such as, but not limited to, the front or sides of the garment, in order to provide support to different muscle groups. The invention can also be designed to fit over different parts of the body, such as the calves, or upper or lower arms. For example, the garment, and associated elasticity elements, can be designed to fit over the upper arms of an athlete, to provide support in activities such as, but not limited to, rowing and swimming.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following description, various embodiments of the present invention are described with reference to an arrangement of elasticity elements in a sport suit or sport pant for running or playing soccer. It is, however, to be understood that the present invention can also be used for garments for other parts of the body and other sports with, for example, repetitive movements of the shoulders and arms, such as in rowing. Other conceivable fields of use are sport disciplines that involve the throwing of objects, such as a discus, a shot put, and a javelin. Finally, the present invention can also provide an active support for repeated everyday movements of a part of the body.

Figure 1A:
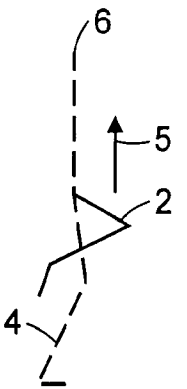
FIGS. 1A-D are schematic representations of different phases of the step cycle of an athlete.

Before the constructional features of the various embodiments are explained in detail, the course of motion during running, and in particular during sprinting, is briefly explained in order to facilitate the understanding of the advantageous energy management by the garment in accordance with the invention. FIGS. 1A to 1D show a schematic representation of the leg motion of a sprinter. In a first phase, shown in FIG. 1A, the right leg 2 is represented by a continuous line, while the left leg 4 and the upper body 6 are represented by a dashed line. In FIG. 1A, the right leg 2 is being lifted in the direction of the arrow 5. The force necessary to lift the right leg 2 is provided by the powerful front muscles of the thighs, which can provide more force than needed in this phase of the step cycle.

Figure 1B:
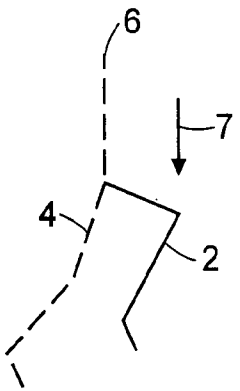
Figure 1C:
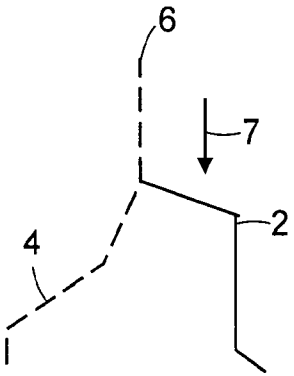
Figure 1D:
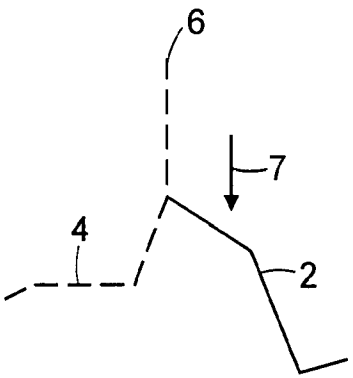

In the subsequent phases of the step cycle, shown in FIGS. 1B-1D, the thigh is put down in the direction of the arrow 7, and the leg is straightened for pushing-off from the ground. The pushing-off and corresponding straightening of the leg is shown for the left leg 4 in FIGS. 1A and 1B. In this phase, the complete weight of the athlete is supported by the muscles of the left leg 4, which is pushing-off. Furthermore, the muscles must cause a change of movement from a landing phase into a push-off phase. The faster and stronger the body is accelerated forward in this moment, by straightening the leg, the higher the velocity that is finally achieved by the sprinter. Therefore, the loads on the muscles peak in this situation. As a result, any additional acceleration of the downwardly moved leg in the direction of the ground can lead to an increase of performance.

Similar movement patterns can be found for other sports, where the muscles of the body are in a first phase loaded significantly below their limit and a maximum of force has to be released in a second phase. For example, a rowing athlete bends his legs essentially without loads since the oars are not in the water during this phase of the motion, but are moved in a backward direction through the air. In the following phase, however, where the legs are straightened, the oars are pulled through the water and the force provided by the thighs is directly proportional to the resulting thrust.

Figure 2A:
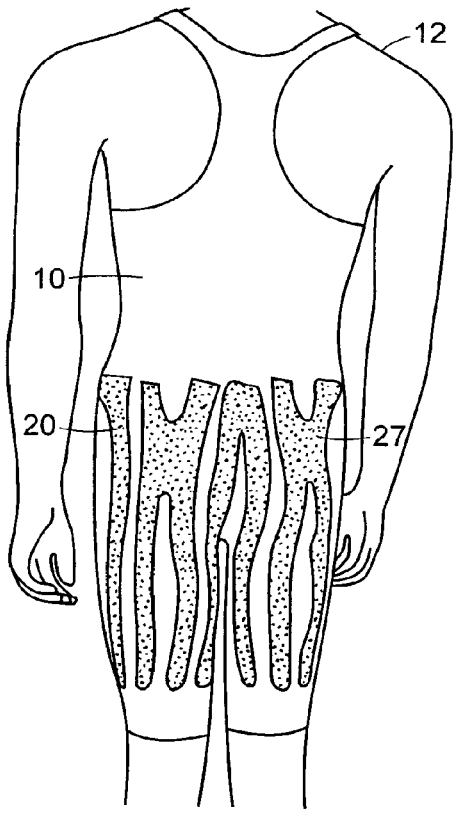
FIG. 2A is a rear view of an arrangement of elasticity elements in a garment for a sprinter, in accordance with one embodiment of the invention.
Figure 2B:
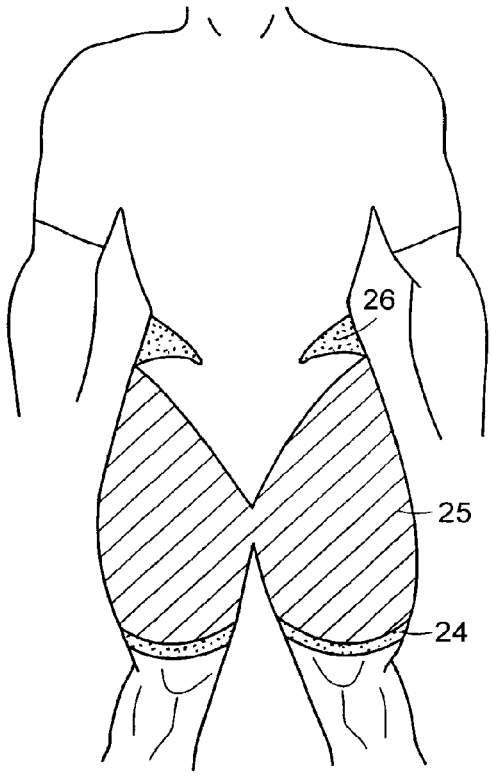
FIG. 2B is a front view of the arrangement of elasticity elements of FIG. 2A.

FIGS. 2A and 2B, respectively, show a rear view and a front view of a garment 10 for efficient energy management of an athlete, in accordance with one embodiment of the invention. To this end, several elasticity elements 20 are arranged on the backside of the garment 10 (for example, a suit for a sprinter 12), in the area of the thighs 25. Essentially no elasticity elements 20 are arranged on the front side of the sport suit 10 in the region of the thighs 25, as represented by the diagonal hatch region of FIG. 2B. Immediately above the knee, but below the thigh, is a lower fastening portion 24 of the elasticity elements 20, which is shaped like a ring and encompasses the leg. Lateral projections 26 of the elasticity elements can be seen above the thigh, and at least partially encompass the waist.

Figure 3:
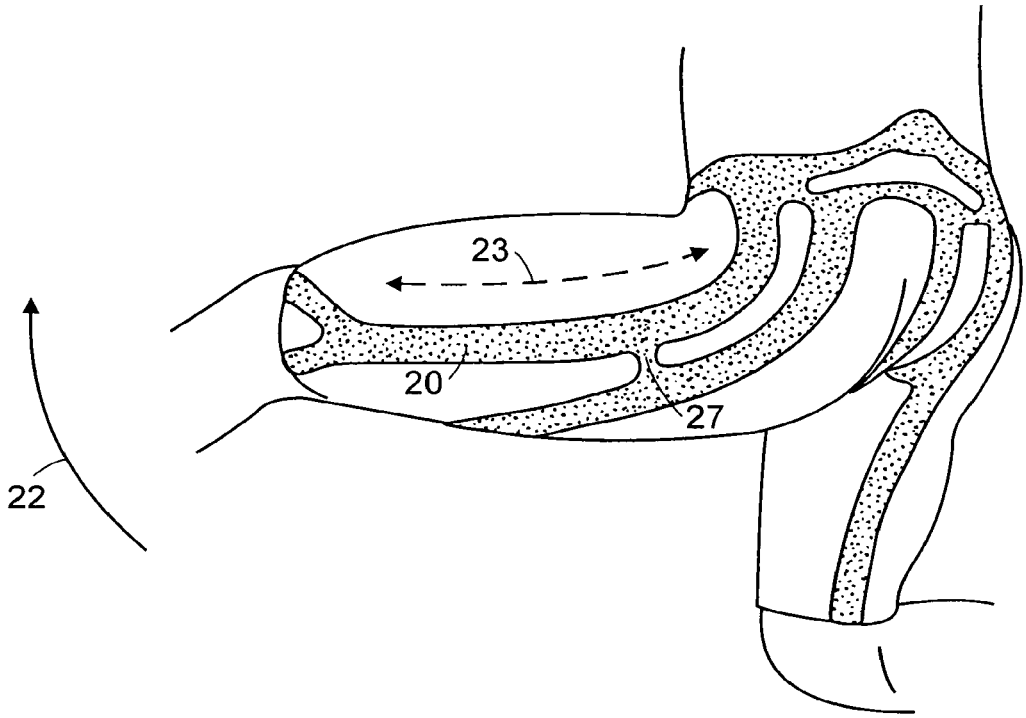
FIG. 3 is a schematic side view of the function of the elasticity elements shown in FIGS. 2A and 2B.

The functional arrangement of the elasticity elements 20 is shown in FIG. 3. When the leg 28 is lifted, as indicated by the continuous arrow 22, the elasticity elements 20 are stretched in the direction of the dashed double headed arrow 23. In addition to overcoming the weight of the leg 28, an athlete wearing the described garment has to provide a force for this movement in order to elongate the elasticity elements 20. Since the elements 20 are elastic, the related work of the athlete is stored as elastic energy within the elements 20.

During the opposite movement, when the leg 28 is again moved downward, for straightening and pushing-off from the ground, the elongated element 20 provides a supporting force accelerating this movement, wherein the energy stored in the elasticity elements 20 is released through the course of the downward movement. As a result, the athlete transfers the available excess force, and the resulting energy generated in a first phase of the movement to a second phase of the movement, so that the excess energy contributes to a greater performance of the athlete.

In a particular embodiment of the invention, when the garment 10 is worn, the at least one elasticity element 20 is arranged essentially on the backside of the thigh and essentially no elastic element 20 is arranged on the front side of the thigh. Thus, in the above described situation of a sprinter, the elasticity element 20 will preferably be elongated each time the leg is lifted, and release energy during the portion of the leg movement when the leg is approaching and contacting the ground. Subsequently, the elasticity element 20 will support a fast and powerful ground contact with the leg for each new push-off in the forward direction.

Referring back to FIG. 2B, the lower fastening portion 24 provides a stable anchor for the elasticity elements 20 through the course of the movements by holding the base of the elasticity elements 20 to the leg below the thigh. The upper fastening portion 26 of the elasticity elements 20, which at least partially encompasses the body on the upper side, provides a stable anchor for the elasticity elements 20 at their upper end. As a result, the stored energy in the stretched elasticity elements 20 pulls the leg in a downward direction during the straightening phase.

In one embodiment, the lower fastening portion 24 and the upper fastening portion 26 can comprise single loops of elastic material, which completely encompass the body at their respective locations, and thus hold the garment firmly against body of the athlete at the lower and upper ends. In an alternative embodiment, at least one of the lower fastening portion 24 or the upper fastening portion 26 can comprise an adjustable strap, with or without elastic material, to provide the athlete with an adjustable fit of the garment. This adjustable strap can comprise a hook and loop fastening system, such as those sold under the registered trademark Velcro®, or another analogous fastening system.

Figure 4:
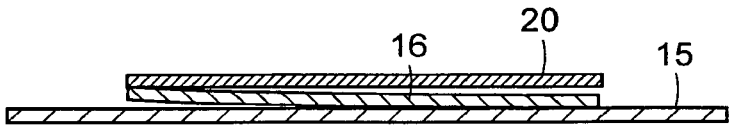
FIG. 4 is a schematic representation of the layers of a garment, in accordance with one embodiment of the invention.
Figure 5C:
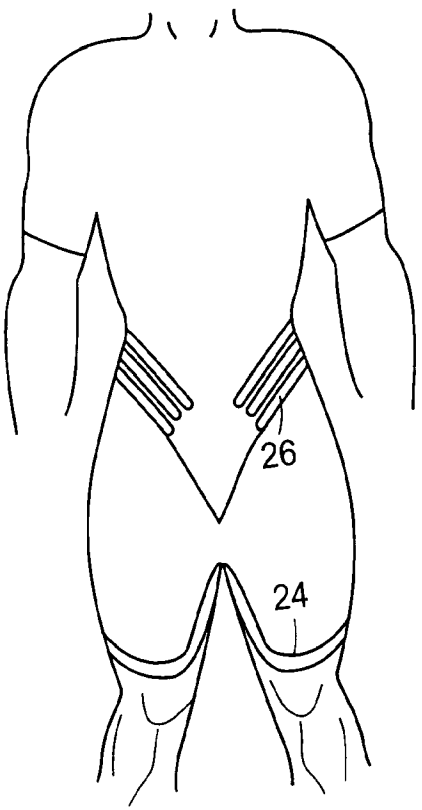
FIG. 5C is a schematic front view of the arrangement of FIG. 5A.
Figure 5B:
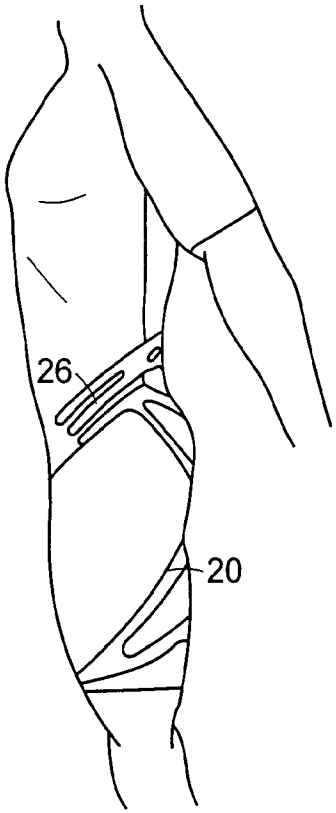
FIG. 5B is a schematic side view of the arrangement of FIG. 5A.
Figure 5A:
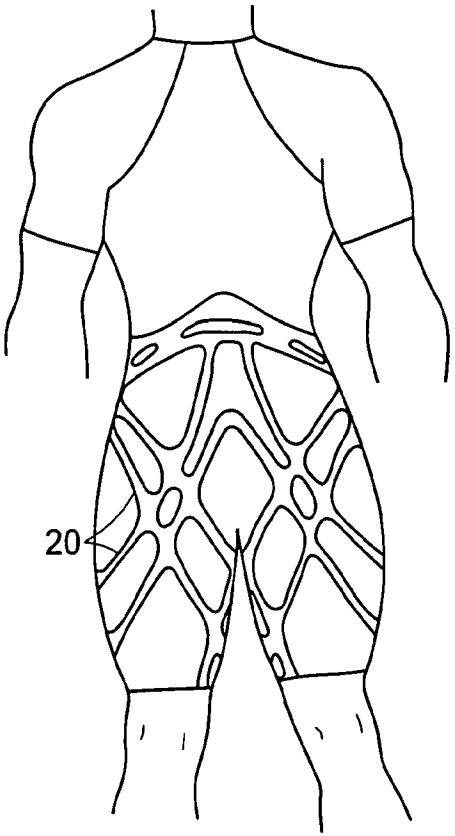
FIG. 5A is a schematic rear view of one arrangement of elasticity elements on an athlete, in accordance with one embodiment of the invention.
Figure 6C:
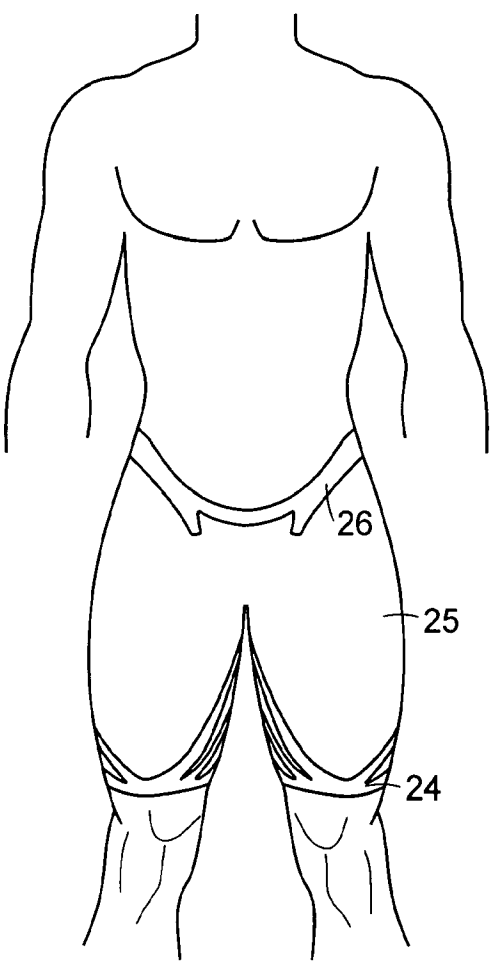
FIG. 6C is a schematic front view of the arrangement of FIG. 6A.
Figure 6B:
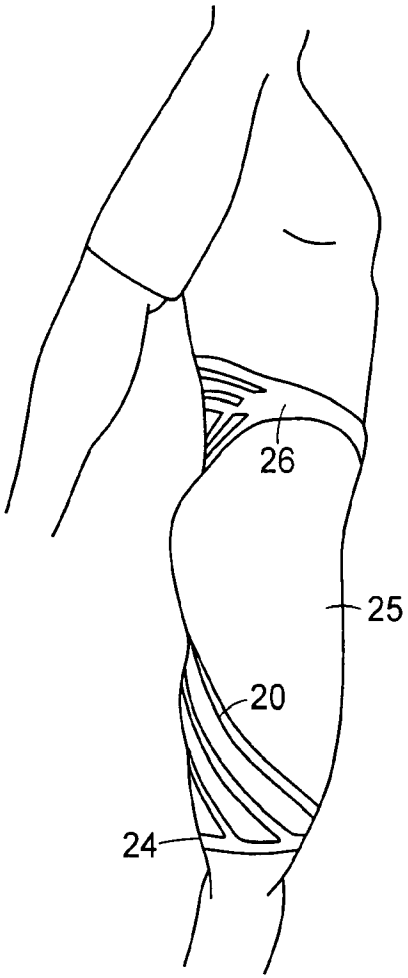
FIG. 6B is a schematic side view of the arrangement of FIG. 6A.
Figure 6A:
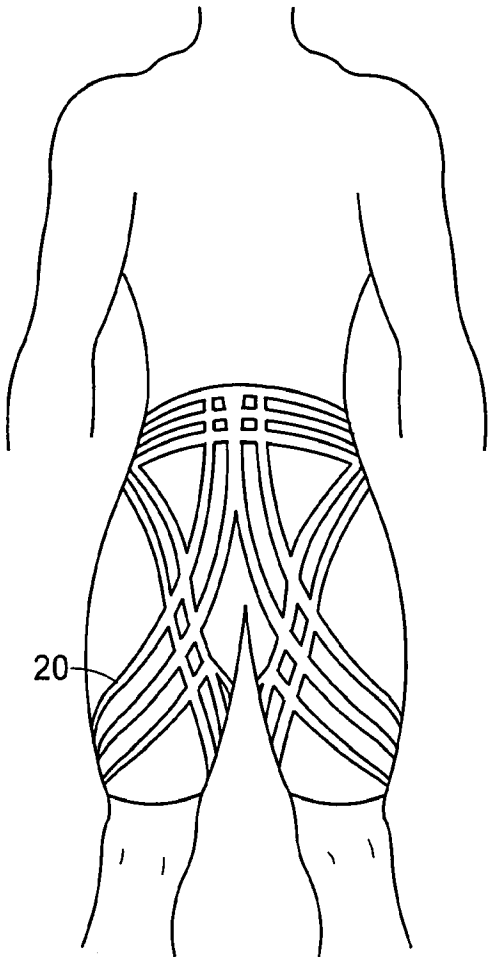
FIG. 6A is a schematic rear view of a second arrangement of elasticity elements on an athlete, in accordance with one embodiment of the invention.
Figure 7C:
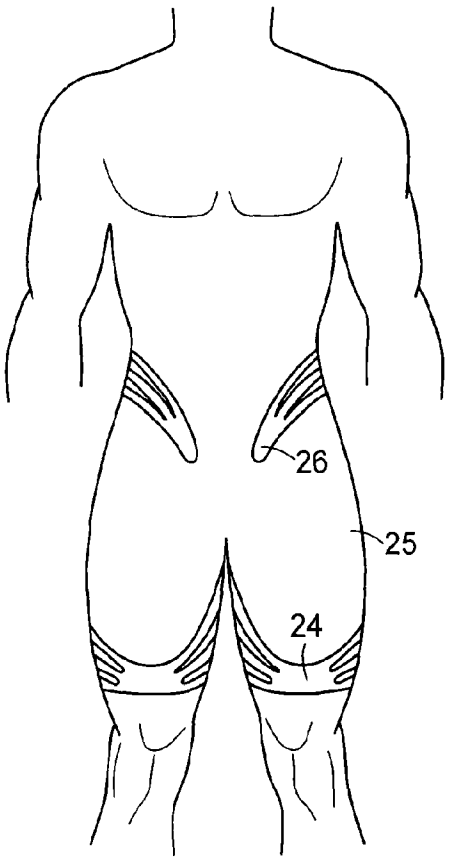
FIG. 7C is a schematic front view of the arrangement of FIG. 7A.
Figure 7B:
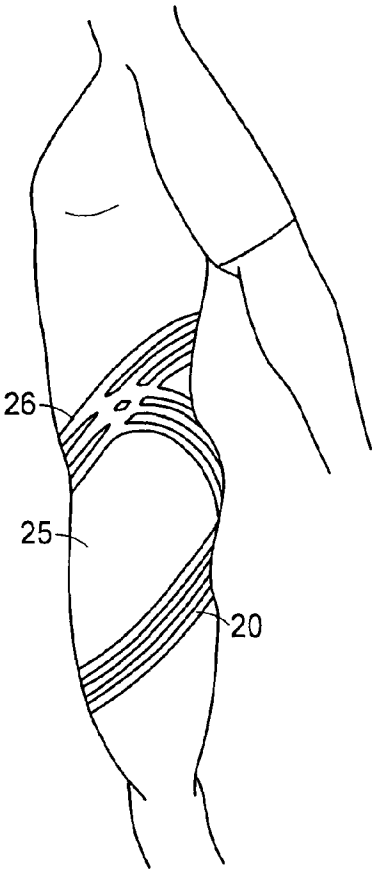
FIG. 7B is a schematic side view of the arrangement of FIG. 7A.
Figure 7A:
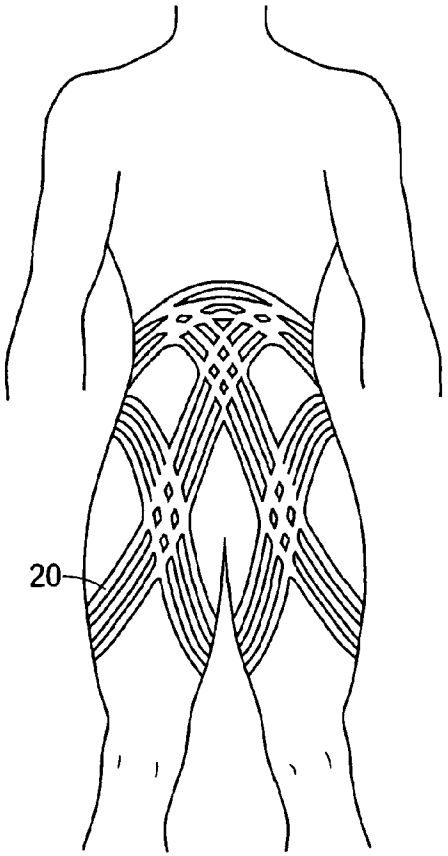
FIG. 7A is a schematic rear view of a third arrangement of elasticity elements on an athlete, in accordance with one embodiment of the invention.

FIG. 4 shows an example of the attachment of an elasticity element 20 onto the garment 10, in accordance with one embodiment of the invention. Firstly, a layer of an adhesive 16 is deposited onto the textile material 15 of the garment 10, with the elasticity element 20 placed on top of the adhesive 16. Both the textile material 15 and the adhesive 16 should also have elastic properties, for example by using elastic textile materials with elastic fibers, such as those sold by DuPont under the registered trademark Lycra®, and an elastic adhesive, such as those available from the company Bemis Associates Inc. under the designation Bemis 3740. Particular adhesives can be activated by heat and, if necessary, pressure so that the elastic bands can be attached to the textile material 15 by heat pressing.

The elastic adhesive 16, which is deposited onto the garment 10 in a manner corresponding to the arrangement of the elasticity elements 20, can also add additional support to the function of the elasticity elements 20. Particular thicknesses of the adhesive layer 16 are in the range of about 0.01 mm to about 0.1 mm, depending on the substance used, its adhesive properties, and its elongation capabilities. For example, if the above mentioned adhesive Bemis 3740 is used, the film can have a thickness of approximately 0.025 mm. The thickness of the Lycra® material 15 arranged below the elasticity elements 20, and the elastic adhesive 16, may vary depending on the field of use of the garment 10, and can be in the range of about 0.1 to about 1 mm. In a particular embodiment, the thickness of the Lycra® material 15 is approximately 0.5 mm.

In one embodiment of the invention, the elasticity element 20 is a flat band made from an elastic plastic material. Apart from bands, the elasticity elements 20 can also be produced from elastic wires or other materials with analogous material properties. The form of a flat band is preferred, however, since elasticity elements 20 with such a shape render the garment 10 the least bulky and increase the wearing comfort. Polymer materials such as a thermoplastic polyurethane (TPU) can be used for the manufacture of the elastic bands, since they combine a low weight with the desired elastic properties. Other plastic materials, however, are also contemplated and within the scope of the invention.

In one embodiment of the invention, the force necessary for the elongation of the elasticity elements 20, and the elastic adhesive layer 16, is approximately 10 times the force necessary for the elongation of a common Lycra® material. In one embodiment, the forces can be between about 5N and about 50N in a standard elongation test with 100% elongation, wherein the material is stretched to 100% of its length and the resulting force produced by the material is measured. In one particular embodiment of the invention, the forces can be between about 10N and about 40N, or between about 20N and about 30N. Such a standard elongation test can, for example, be performed using an Instron machine. For permanent or long term energy management using the garment 10, it is also preferred that the elasticity element 20, and also the adhesive layer 16 used for its attachment, can be heavily stretched, i.e. up to 100%, over many load cycles, without delaminations.

The elastic properties of the elasticity elements 20 are not only determined by the material used for their construction, but also by the thickness of the elastic band used, which is preferably in the range of about 0.1 mm to about 1 mm. For example, in one embodiment of the invention a value of about 0.2 mm can be used for the thickness of the elastic band. The width of the elasticity elements 20 may also vary along their longitudinal extension. In one embodiment, the width of the elasticity elements 20 is between approximately 1 cm and 5 cm.

As well as using adhesive 16 to attach the elasticity element 20 to the textile material 15, it is also conceivable to sew the elasticity elements 20 to the underlying textile material 15 or to attach them in any other way. The selection of the thread for sewing, and sewing techniques used, also have to take the considerable elongation, of up to 100%, into account.

Other methods of manufacture are also possible. For example, the elasticity elements 20 can be directly integrated into the fabric of the garment 10 by using different starting materials for the fabric in desired sections. In one embodiment of the invention, elastic plastic material can be directly printed onto the fabric, or injected onto the fabric, in order to locally modify its elasticity. Finally, the elasticity elements 20 can be secured to the outside of the garment 10 by a further textile layer covering the elasticity element 20.

FIGS. 2A, 2B, and 3 disclose an embodiment of the invention which is particularly suited for track and field athletes. The elasticity elements 20 extend essentially parallel to the thigh, wherein additional interconnections 27 can be arranged between several parallel elasticity elements 20. This arrangement provides the greatest support for the athlete in activities that require a predominantly straight running motion.

FIGS. 5A to 7C disclose further alternative embodiments of the invention, wherein the elasticity elements 20 extend diagonally over the backside of the thigh. These embodiments can be used, for example, for the pants and suits of soccer players. By incorporating elasticity elements 20 that extend diagonally, the garments in FIGS. 5A to 7C can support frequent changes in direction, since the supporting forces provided by the elasticity elements 20 do not act exclusively parallel to the leg.

As well as the thickness, width, and the shape of each elasticity element 20, their number and arrangement can also influence the extent of the energy storage available to each embodiment of the invention. For example, the embodiments shown in FIGS. 6A to 7C have several groups of elasticity elements 20 including three bands, that extend in parallel and provide a stronger supporting effect during straightening of the leg than the embodiment of FIGS. 5A-5C, wherein each group of elasticity elements 20 comprises only two bands. The work necessary for storing energy, however, will be greater in the embodiments of FIGS. 6A to 7C, so that these embodiments are more suitable for well-trained athletes.

The arrangements shown in FIGS. 5A to 7C, including crossing, diagonally extending elasticity elements 20, efficiently use the available area on the backside of the thigh and allows a smooth transition into the lower fastening portion 24 arranged above the knee and below the thigh. The upper end lateral projections 26 of the upper fastening portion may also fully enclose the body, such as in the embodiment of FIGS. 6A-6B, and thereby additionally improve the energy storing function of the garment 10.

Figure 8C:
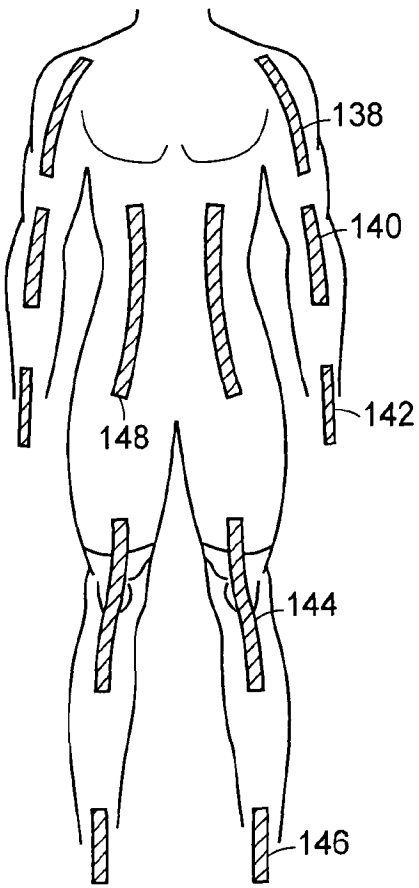
FIG. 8C is a schematic front view of the arrangement of FIG. 8A, including additional alternative locations for elasticity elements.
Figure 8B:
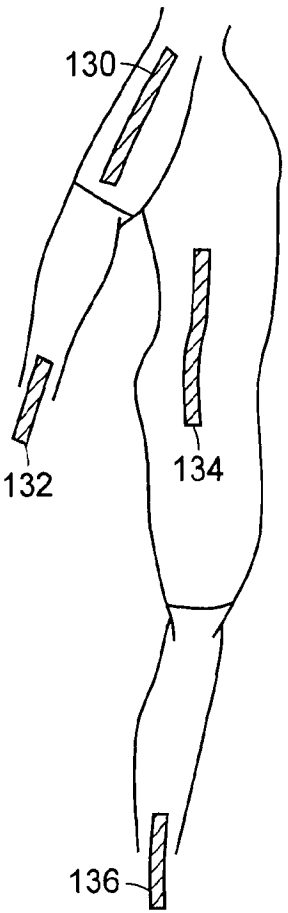
FIG. 8B is a schematic side view of the arrangement of FIG. 8A, including additional alternative locations for elasticity elements.
Figure 8A:
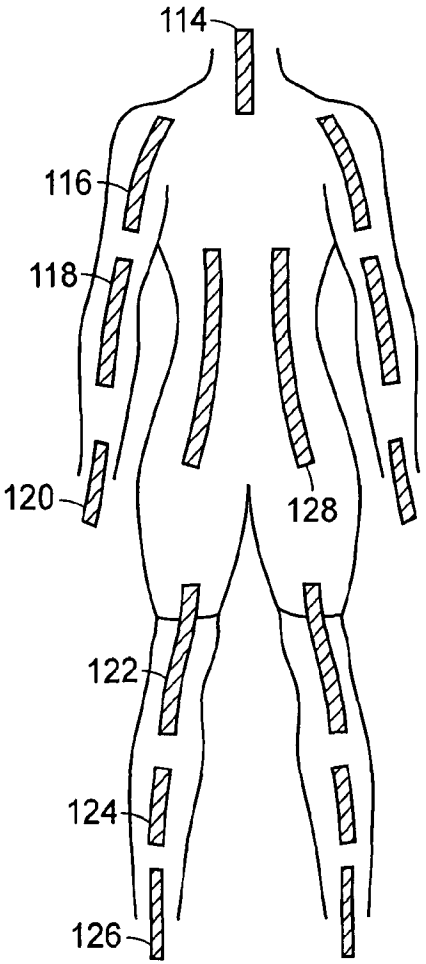
FIG. 8A is a schematic rear view of alternative locations for elasticity elements on an athlete, in accordance with one embodiment of the invention.

In alternative embodiments of the invention, elasticity elements can be placed on other portions of the body of a person. FIGS. 8A to 8C show a number of possible locations at which elasticity elements can be placed to support the movement of an athlete when, for example, throwing, kicking, and twisting.

FIG. 8A shows a rear view of an athlete 112 with a number of locations for elasticity elements depicted. Elasticity elements can be seen positioned at the back of the neck 114, the back of the shoulder 116, the elbow 118, and the wrist 120, and at the back of the knee 122, the calf 124, and the ankle 126. Support for an upper body movement can also be provided by at least one elasticity element on the back 128 of the athlete.

FIG. 8B shows a side view of an athlete 112 with a number of additional locations for elasticity elements depicted. In FIG. 8B, elasticity elements are positioned on the outside of the shoulder 130, the outside of the wrist 132, the side of the waist 134, and the outside of the ankle 136 of the athlete.

FIG. 8C shows a front view of an athlete with additional locations for elasticity elements depicted. In FIG. 8C, elasticity elements have been positioned at the front of the shoulder 138, the elbow 140, and the wrist 142. Further elasticity elements are positioned on the front of the knee 144, the front of the ankle 146, and the stomach 148 of the athlete.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A garment for at least a lower portion of a body, the garment comprising:

a fabric disposable over at least a portion of a lower body of a wearer at a location corresponding to at least a portion of a front region, an outer side region, and a rear region of the lower body, when worn, wherein the fabric comprises:

a front fabric portion corresponding to at least a portion of the front region of the lower body;

a side fabric portion corresponding to at least a portion of the outer side region of the lower body; and a rear fabric portion corresponding to at least a gluteus maximus region of the lower body; and at least one elasticity element associated with the fabric, the at least one elasticity element comprising a plurality of bands arranged in at least a single layer and extending at least partially over the rear fabric portion and the side fabric portion, wherein the at least one elasticity element is adapted to provide support for a lower body movement of the wearer.

2. The garment of claim 1, wherein the at least a single layer plurality of bands extend from at least one common branch location positioned on the rear fabric portion.

3. The garment of claim 1, wherein the front fabric portion is positioned substantially opposite the rear fabric portion and is substantially free of the at least one elasticity element.

4. The garment of claim 1, wherein the at least a single layer plurality of bands extend from at least one common branch location positioned on the side fabric portion.

5. The garment of claim 1, wherein the at least a single layer plurality of bands extend as substantially lateral projections from at least one common branch location.

6. The garment of claim 1, wherein the at least a single layer plurality of bands extend as substantially longitudinal projections from at least one common branch location.

7. The garment of claim 1, wherein the garment comprises energy storing capacity by elastic elongation of the at least one elasticity element under a first movement of the lower body and the garment comprises energy releasing capacity under a second movement of the lower body in an opposite direction, the garment supporting the second movement of the lower body.

8. The garment of claim 1, wherein the at least one elasticity element comprises at least two common branch locations.

9. The garment of claim 8, wherein a first common branch location is located on the rear fabric portion at a position corresponding to a rear of a first upper leg of the wearer, and a second common branching location is located on the rear fabric portion at a position corresponding to a rear of a second upper leg of the wearer, when worn.

10. The garment of claim 9, wherein each common branch location is located on the rear fabric portion at a position corresponding to a substantially central location of a rear of each upper leg of the wearer, when worn.

11. The garment of claim 1, wherein the at least one elasticity element extends at least partially over the rear fabric portion corresponding to a rear of both upper legs of the wearer, when worn.

12. The garment of claim 1, wherein the at least one elasticity element has a thickness of less than approximately 1 mm.

13. The garment of claim 1, wherein the at least one elasticity element has a thickness of approximately 0.2 mm.

14. The garment of claim 1, wherein at least one of a thickness and a width of the at least one elasticity element varies.

15. The garment of claim 1, wherein the at least one elasticity element comprises a thermoplastic polymer.

16. The garment of claim 1, wherein the at least one elasticity element is at least one of glued to, sewn to, printed onto, or injected onto the fabric.

17. A garment for at least a lower portion of a body, the garment comprising:

a fabric disposable over at least a portion of a lower body of a wearer at a location corresponding to at least a portion of a front region, an outer side region, and a rear region of the lower body, when worn, wherein the fabric comprises:

a front fabric portion corresponding to at least a portion of the front region of the lower body;

a side fabric portion corresponding to at least a portion of the outer side region of the lower body; and a rear fabric portion corresponding to at least a gluteus maximus region of the lower body; and at least one elasticity element associated with the fabric, the at least one elasticity element comprising a web-like arrangement of bands arranged in at least a single layer and extending at least partially over the rear fabric portion and the side fabric portion, wherein the at least one elasticity element is adapted to provide support for a lower body movement of the wearer.

18. A garment for an upper portion and a lower portion of a body, the garment comprising:

a fabric disposable over at least a portion of an upper body and a lower body of a wearer at a location corresponding to at least a portion of a front region, an intermediate region, and a rear region of the upper body and the lower body, when worn, wherein the fabric comprises:

a front fabric portion corresponding to at least a portion of the front region of the upper body and the lower body;

an intermediate fabric portion corresponding to at least a portion of the intermediate region of the upper body and the lower body; and a rear fabric portion corresponding to at least a portion of the rear region of the upper body and a gluteus maximus region of the lower body; and at least two elasticity elements associated with the fabric, each elasticity element comprising a web-like arrangement of bands arranged in at least a single layer and extending at least partially over the rear fabric portion and the intermediate fabric portion, wherein each elasticity element is adapted to provide support for an upper body movement and a lower body movement of the wearer.

19. A garment for an upper portion and a lower portion of a body, the garment comprising:

a fabric disposable over at least a portion of an upper body and a lower body of a wearer at a location corresponding to at least a portion of a front region, an intermediate region, and a rear region of the upper body and the lower body, when worn, wherein the fabric comprises:

a front fabric portion corresponding to at least a portion of the front region of the upper body and the lower body;

an intermediate fabric portion corresponding to at least a portion of the intermediate region of the upper body and the lower body; and a rear fabric portion corresponding to at least a portion of the rear region of the upper body and a gluteus maximus region of the lower body; and at least two elasticity elements associated with the fabric, each elasticity element comprising a plurality of bands arranged in at least a single layer and extending at least partially over the rear fabric portion and the intermediate fabric portion, wherein each elasticity element is adapted to provide support for an upper body movement and a lower body movement of the wearer.

* * * * *